US006955232B2

(12) United States Patent
Flaugere

(10) Patent No.: US 6,955,232 B2
(45) Date of Patent: Oct. 18, 2005

(54) EQUIPMENT FOR DRILLING VERTICAL BOREHOLES

(75) Inventor: Bernard Flaugere, Nanterre (FR)

(73) Assignees: Compagnie du Sol, Nanterre (FR); The Robbins Company, Solon, OH (US)

( * ) Notice: Subject to any disclaimer, the term of this patent is extended or adjusted under 35 U.S.C. 154(b) by 0 days.

(21) Appl. No.: 10/301,180

(22) Filed: Nov. 20, 2002

(65) Prior Publication Data

US 2003/0151298 A1 Aug. 14, 2003

(30) Foreign Application Priority Data

Nov. 20, 2001 (FR) ..... 01 14975

(51) Int. Cl.[7] ..... E21B 4/18
(52) U.S. Cl. ..... 175/97; 175/99; 175/230; 299/31; 405/249
(58) Field of Search ..... 299/31; 175/92, 175/94, 97, 98, 99, 230; 405/231, 249, 251, 405/257

(56) References Cited

U.S. PATENT DOCUMENTS

| | | | | | |
|---|---|---|---|---|---|
| 1,147,898 | A | * | 7/1915 | Seitz | 175/98 |
| 1,188,001 | A | * | 6/1916 | May | 175/95 |
| 1,380,203 | A | * | 5/1921 | Glick | 175/97 |
| 1,880,217 | A | * | 10/1932 | Simmons | 175/97 |
| 2,091,779 | A | * | 8/1937 | Gooder | 175/98 |
| 2,221,226 | A | * | 11/1940 | Wick | 405/133 |
| 2,946,578 | A | * | 7/1960 | De Smaele | 299/1.3 |
| 3,376,942 | A | * | 4/1968 | Van Winkle | 175/81 |
| 3,881,776 | A | * | 5/1975 | Fashbaugh et al. | 299/31 |
| 4,463,814 | A | * | 8/1984 | Horstmeyer et al. | 175/45 |
| 4,494,617 | A | * | 1/1985 | Snyder | 175/86 |
| 4,526,242 | A | * | 7/1985 | Mathieu et al. | 175/94 |
| 4,688,854 | A | | 8/1987 | Pfeiffer | |
| 5,649,745 | A | * | 7/1997 | Anderson | 299/31 |

FOREIGN PATENT DOCUMENTS

| | | |
|---|---|---|
| DE | 169 319 | 4/1906 |
| FR | 2 234 448 | 1/1975 |
| FR | 2 275 633 | 1/1976 |
| GB | 938 191 | 10/1963 |

* cited by examiner

*Primary Examiner*—John Kreck
(74) *Attorney, Agent, or Firm*—Merchant & Gould P.C.

(57) ABSTRACT

The invention relates to equipment for drilling a vertical borehole in hard ground, the equipment comprising:

casing put successively into place in the borehole;

a drilling machine having a rotary cutting head and presenting a structural frame;

torque and thrust transmission means having a first end secured to the structural frame of the drilling machine; and securing means for securing the second end of the torque and thrust transmission means in translation and in rotation to said casing.

16 Claims, 4 Drawing Sheets

FIG.3A
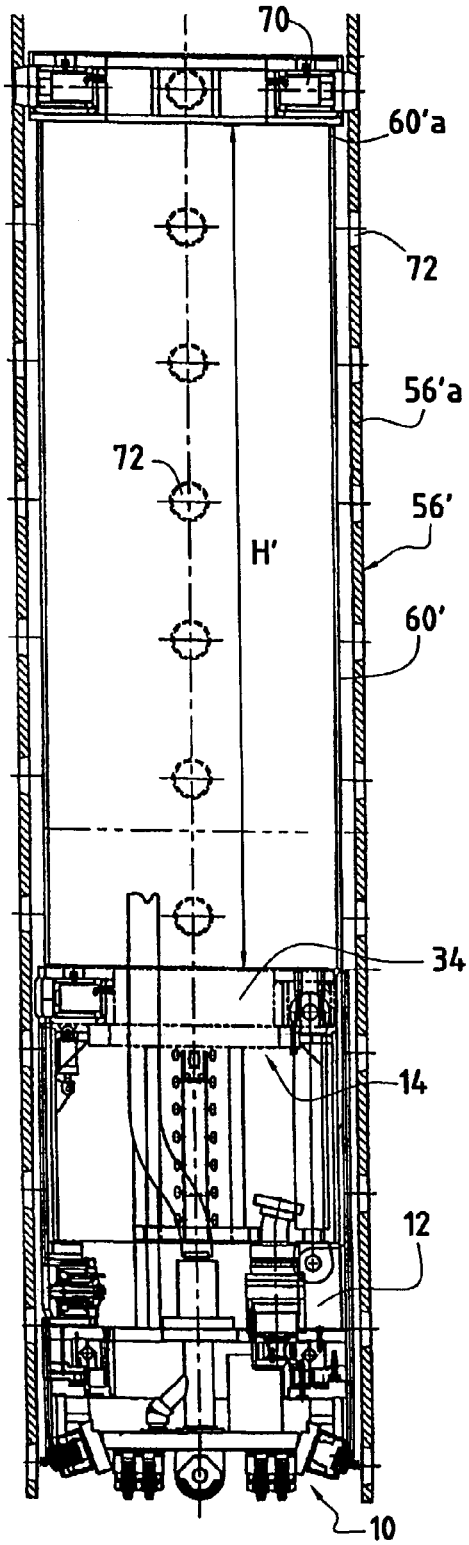
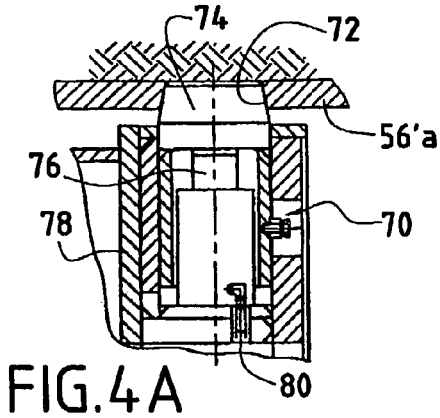
FIG.4A
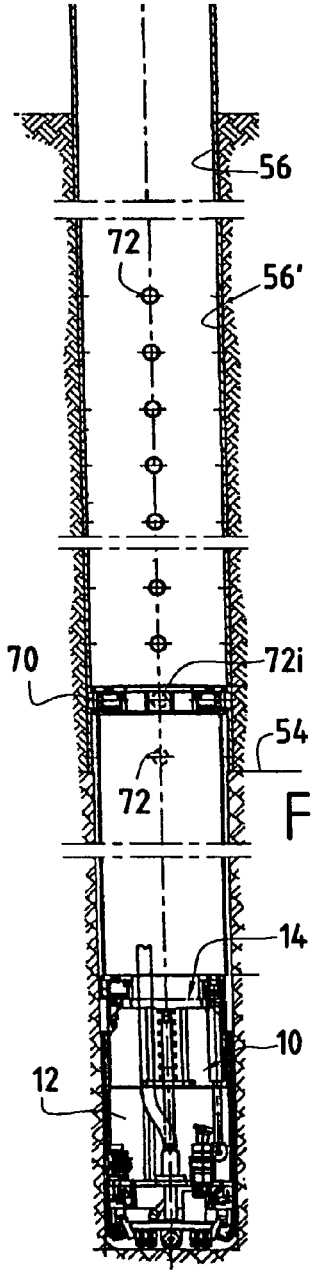
FIG.4B

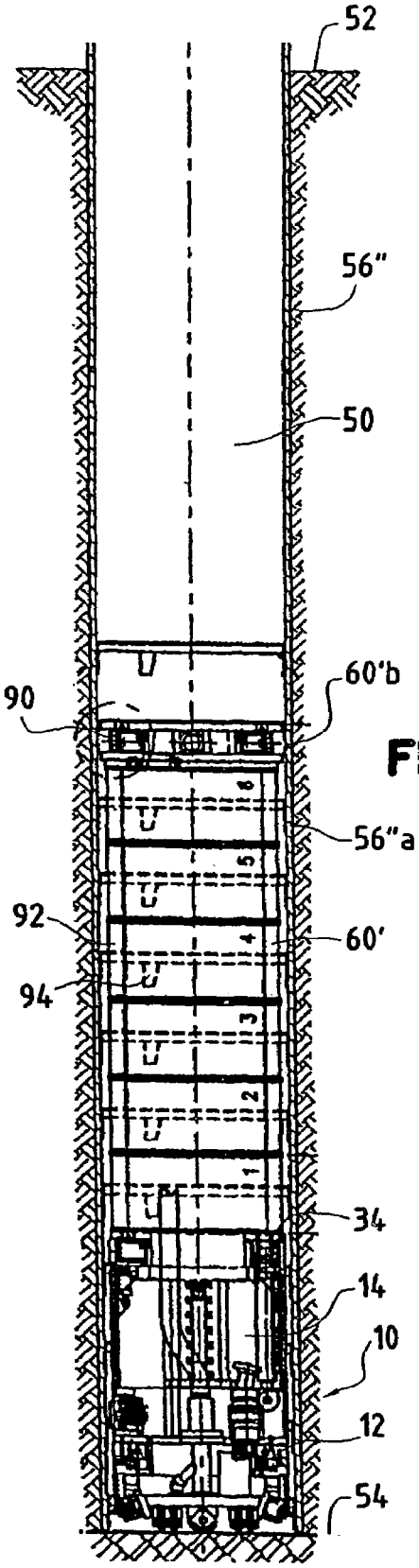
FIG.5A
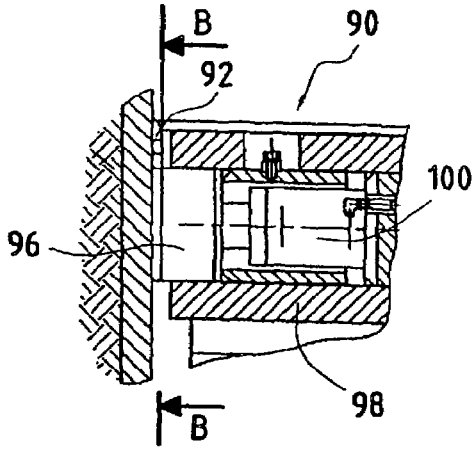
FIG.5B
FIG.5C
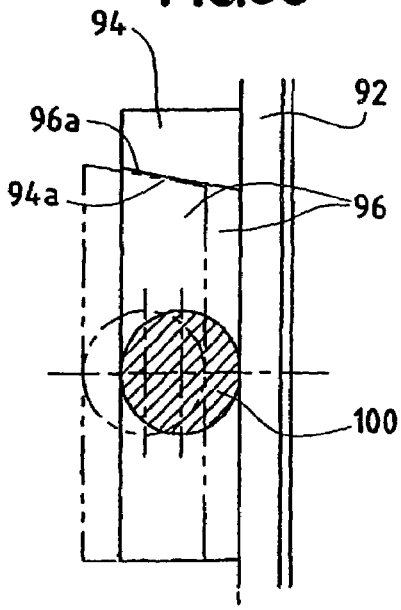

EQUIPMENT FOR DRILLING VERTICAL BOREHOLES

The invention relates to equipment for drilling vertical boreholes, typically but not exclusively for making bored piles of great depth.

BACKGROUND OF THE INVENTION

When starting a project, it is often necessary to begin by installing a foundation constituted by bored piles made in the ground where the project is to be built. That technique consists in drilling a borehole in the ground of diameter matching that of the pile that is to be made, and then filling the borehole with concrete or group or some other suitable material.

There also exist so-called tunneling machines having a rotary head that are used to make tunnels that are horizontal or substantially horizontal, and that might pass through rock that is very hard, such as granite. Nevertheless, it will be understood that the conditions under which vertical boreholes are made are completely different from those encountered when digging a tunnel.

While drilling a borehole, the drilling machine is immersed in a fluid that fills the borehole. In addition, in order to reach the layer of hard rock, it is often necessary to drill to great depth, e.g. About 15 meters (m) to 50 m through layers that are softer. During this operation, as the borehole advances, it is necessary to install successive casing elements or to maintain the excavation by means of an appropriate drilling fluid.

It will also be understood that the rotary head cutting machine must be capable of developing very high levels of thrust, e.g. Of the order of 500 (metric) tones (t), together with a very high level of torque when drilling into granite.

It is therefore necessary to be able to take up said thrust and said torque as developed by the cutting machine at a depth which can be quite considerable, e.g. 15 m to 50 m, and in a space that is full of water, bentonite mud, or an appropriate drilling fluid.

It can clearly be seen that the techniques for taking up thrust and torque that are appropriate for use with conventional tunneling machines are unsuitable for use in conditions corresponding to drilling boreholes to make bored piles.

It should also be added that "large-diameter bored piles" means piles having a diameter of about 1.5 m to 4 m. This size is very different from that which is encountered when making a tunnel.

OBJECTS AND SUMMARY OF THE INVENTION

There therefore exists a real need for equipment making it possible to drill vertical boreholes of great depth and in ground that is very hard, at least in part.

An object of the present invention is to provide equipment for drilling vertical boreholes in very hard ground, which equipment is effective and makes it possible to drill such boreholes with a diameter of about 1.5 m to 4 m.

According to the invention, this object is achieved by equipment for drilling vertical boreholes in hard ground, the equipment comprising:

casing put successively into place in the borehole;

a drilling machine having a rotary cutting head and presenting a structural frame;

torque and thrust transmission means having a first end secured to the structural frame of the drilling machine; and securing means for securing the second end of the torque and thrust transmission means in translation and in rotation to said casing.

It will be understood that in the invention the torque and the thrust developed by the rotary head cutting machine are ultimately taken up by the casing itself. This is made possible either by exerting a force on the top end of the casing or else because of the weight of the casing as a whole and because of the very high level of friction that exists between the outside face of the casing and the surrounding ground.

More precisely, the thrust and the torque are finally taken up by the casing via the torque and thrust transmission means which are preferably constituted by sections of tube that are welded to one another and via securing means for securing the transmission means relative to the casing both in translation and rotation.

In a first embodiment of the invention, in the equipment said securing means comprise an annular body secured to the second end of the thrust and torque transmission means, and expandable means mounted on the outside face of said body and suitable for occupying a first position at rest and an active second position in which the expandable means apply pressure to the inside face of the casing.

In this embodiment of the invention, torque and thrust are taken up by an assembly fixed to the end of the torque and thrust transmission means. The assembly comprises a cylindrical body having expandable elements mounted on the outside face thereof which thus faces the inside face of the casing. In their expanded state, these elements press against the inside face of the casing with sufficient pressure over sufficient area to ensure that the thrust and torque transmission means are secured both in translation and in rotation.

The expandable elements may be inflatable envelopes which are inflated by means of a fluid under pressure, or they may be pressure shoes controlled by actuators that are movable in radial directions of the borehole.

In a second embodiment, in the equipment, said securing means comprise a plurality of catch elements formed in the inside face of the casing, and moving locking members mounted at the second end of the torque and thrust transmission means, said locking members being suitable for taking up a retracted first position at rest and an active second position in which they Co.-operate in rotation and in translation with the catch elements.

In this embodiment, the torque and thrust are taken up by Co-operation between a plurality of series of catch elements provided in the casing, and moving locking members carried by the transmission means. As the rotary drilling head advances, it passes from one series of catch elements to the next deeper series of catch elements.

In a third embodiment, in the equipment, said securing means comprise a plurality of tube elements securable to the second end of the torque and thrust transmission means and securable to one another and to fixing means for fixing the top tube element in translation and in rotation to the top end of the casing.

In this third embodiment, the torque and thrust transmission means are extended by tube elements which are put into place in the borehole and secured to one another as the drilling head advances. The top end of the set of tube elements is flush with the surface of the ground and is secured by means of a "cap" both in translation and in rotation to the top end of the casing situated above ground level.

BRIEF DESCRIPTION OF THE DRAWINGS

Other characteristics and advantages of the invention appear better on reading the following description of various embodiments of the invention given as non-limiting examples. The description refers to the accompanying figures, in which:

FIG. 3A is a longitudinal section view of a first embodiment of the drilling equipment;

FIG. 3B is a fragmentary view showing details of the FIG. 3A equipment, showing a preferred embodiment of the expandable elements;

FIG. 4A is a longitudinal section view of a second embodiment of the drilling equipment;

FIG. 4B is a fragmentary view of a detail of the FIG. 4A equipment;

FIG. 4C shows the FIG. 4A drilling equipment at the end of drilling;

FIG. 5A is a longitudinal section view of a variant of the second embodiment of the drilling equipment;

FIG. 5B is a fragmentary view showing details of the locking members of the FIG. 5A equipment;

FIG. 5C is a section view on line B–B' of FIG. 5B; and

MORE DETAILED DESCRIPTION

Figure 1:
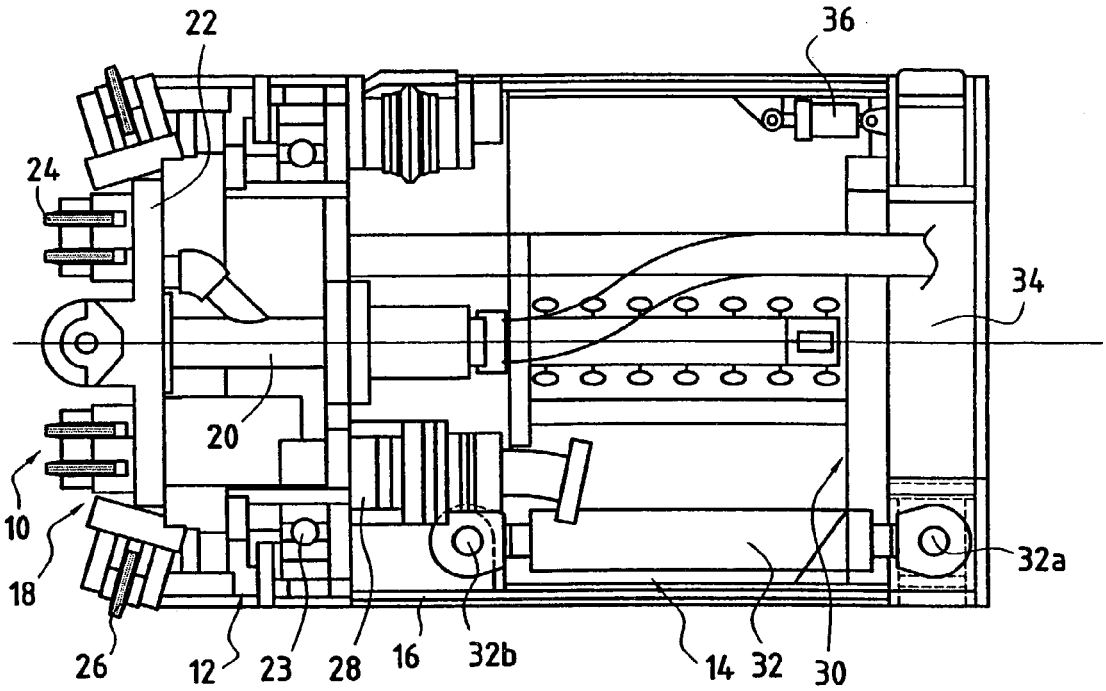
FIG. 1 is a simplified longitudinal section view of a rotary head cutting machine.
Figure 2A:
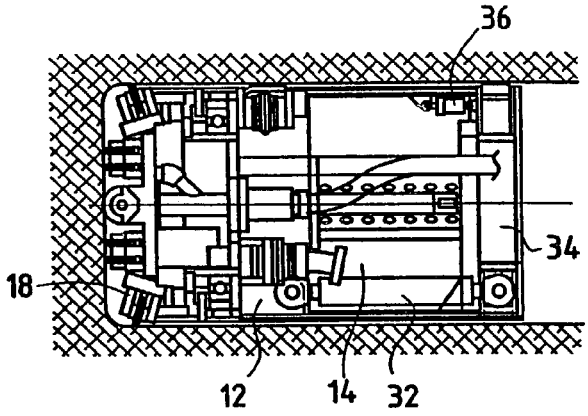
FIGS. 2A and 2B show the FIG. 1 machine in the retracted state and in the expanded state.
Figure 2B:
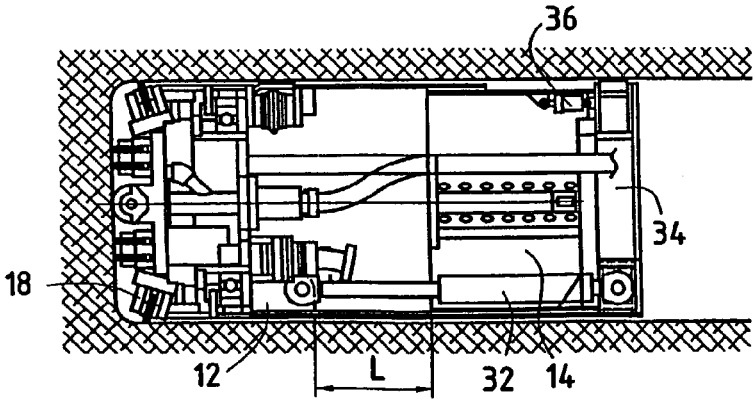

With reference initially to FIGS. 1, 2A, and 2B, a rotary head cutting machine is described which is preferably used in the drilling equipment of the invention. Nevertheless, other rotary head drilling machines could also be used. A machine of this type is well known in its use for making tunnels, so it is described in simplified manner only, in order to show up its main elements.

As can be seen in FIG. 1, the rotary head cutting machine 10 has a front portion 12 and a rear portion 14, these two portions being mounted telescopically relative to each other.

The front portion 12 comprises a cylindrical outer structural frame 16 having a rotary cutting head 18 mounted therein by a bearing. The head 18 is mounted to rotate about the longitudinal axis XX' of the machine. It has a rotary drive shaft 20 with a rotary plate 22 supported by bearings 23 fixed to one end thereof. The plate carries front cutting disks 24 and "corner" cutting disks 26. The shaft 20 is rotated by means of a motor unit 28 carried by the structural frame 16.

The rear portion 14 of the machine comprises an inner structural frame 30 which is connected to the structural frame 16 constituting the front portion 12 by axial thrust actuators such as 32. The structural frame 30 essentially comprises a ring 34 for taking up thrust and having fixed thereto the first ends 32*a* of thrust actuators 32 whose opposite ends 32*b* are secured to the structural frame 16 of the front portion of the cutting machine. A small amount of bending motion is also possible between the front portion 12 and the rear portion 14 of the machine so that these two portions of the machine can take up a small relative angle, under the control of the actuators 36.

While the machine is in use, the rear portion 14 is stationary and the front portion 12 moves forwards as the cutting head 18 performs drilling. FIGS. 2A and 2B show the two extreme positions of the front portion 12 relative to the rear portion 14.

When the cutting head 18, i.e. the front portion 12 of the machine has advanced through a length L defined by the actuator 32, the rear portion 14 is brought back into the position shown in FIG. 2A relative to the front portion 12, and a new rock-cutting cycle can begin. Typically the length L of a drilling cycle is equal to 0.8 m.

As already explained briefly, the drilling equipment of the invention which uses a cutting machine of the type described with reference to FIGS. 1 and 2, or of an analogous type, essentially comprises means for taking up the torque and the thrust that the take-up ring 34 of the rear portion 14 of the cutting machine receives in reaction. The purpose of these means, for each drilling cycle corresponding to a length L, is to prevent the take-up ring 34 from moving in rotation or translation relative to the casing elements that have been put into place in the borehole. These torque and thrust take-up means comprise firstly a cylindrical force and torque transmission part having a first end secured to the rear portion 14 of the machine and more precisely to the take-up ring 34, and secondly an assembly at a second end of the transmission part and serving during each drilling cycle to secure the cylindrical transmission part in rotation and in translation relative to the casing elements.

In other words, the different embodiments of the invention correspond to different systems for securing the second end of the cylindrical thrust and torque transmission part relative to the casing elements.

With reference now to FIGS. 3 and 3A, a first embodiment of the invention is described in which this is achieved by expandable means.

FIG. 3 shows the borehole 50 being drilled, the ground surface 52, and the beginning 54 of a layer of hard rock. As drilling progresses, bolted-together casing elements 56*a* are put into place in the borehole so as to constitute the casing 56 that extends over the full depth H of the borehole in the layer that is not hard. As already mentioned, this depth may lie in the range 15 m to 50 m.

The drilling head 10, and more precisely its take-up ring 34 is secured by any suitable means to the first end 60*a* of a cylindrical torque and thrust transmission part 60. Its axis coincides with the axis of the casing 56. The length H' of this part is such that when added to the length of the machine 10 in its extended state, a total length is obtained that is slightly greater than the desired depth of drilling into hard rock. For a drilling depth of 8 m, the length H' of the part 60 is about 5.5 m. The diameter of the part 60 is equal to the diameter of the cutting head. In the example described, it is therefore 1.8 m.

The assembly 62 for securing to the casing 56 comprises a cylindrical body 64 of diameter that is slightly smaller than the diameter of the part 60, together with inflatable envelopes such as 66 which are fixed to the outside face of the body 64 facing the casing 56. The inflatable envelopes 66 are connected by pipes 68 to a source of fluid under pressure.

FIG. 3A shows the securing assembly 62 in greater detail. The ring 64 forming the cylindrical body has a flange 64*a* at its bottom end for fixing to the part 60. In the embodiment shown, there are two inflatable envelopes 66*a* and 66*b* in the axial direction, and there are six inflatable envelopes around the circumference. These envelopes are fed together or individually by pipes 68 for feeding fluid under pressure. The total surface area of the inflatable envelopes that comes into contact with the inside face of the casing 56 must be sufficient to ensure that torque and thrust are taken up effectively. The pressure of the fluid inflating the expandable envelopes is necessarily limited, in particular in order to avoid deforming the casing 56.

During the drilling cycle, the envelopes 66 are in the expanded state so as to be secured in rotation and in translation relative to the casing, and thus take up forces. Once a drilling cycle terminates, the envelopes 66 are emptied of fluid under pressure and the assembly 62 moves down along the borehole together with the transmission part 60 through a length L corresponding to a length of one drilling cycle.

In a variant, the inflatable envelopes 66 may be replaced by pressure shoes of sufficient surface area that can be moved radially between a retracted position and a position in which they bear against the inside face of the casing 56. Each shoe is fixed to the end of the rod of a hydraulic actuator mounted on the cylindrical body 64.

A second embodiment of the invention is described below with reference to FIGS. 4, 4A, and 4B.

In this embodiment, there can be seen the rotary head drilling machine 12 and the cylindrical thrust and torque transmission part 60. Compared with the first embodiment, the difference lies in the way in which the transmission part is secured to the casing.

The force transmission part is given reference 60' in this embodiment and it is fitted at its top end 60'*a*, i.e. its end remote from the cutting machine 10, with four locking fingers such as 70 which are described in greater detail below.

The casing elements are referenced 56'*a* and they are constituted by cylindrical metal rings each provided with four catch orifices 72 lying in a common plane orthogonal to the longitudinal axis of the casing 56' and angularly offset by 90°. A series of four orifices 72 is separated from the following series of four orifices by a distance h corresponding to a length L of a drilling cycle. Naturally, only the lower casing elements that correspond to the length of drilling into hard rock are provided with orifices 72. The other casing elements do not have orifices. The orifices 72 constitute catch elements for the fingers 70.

FIG. 4A shows a locking finger 70 in greater detail. It should first be mentioned that the orifices 72 are preferably frustoconical and that the locking finger 70 comprises a shoe 74 which is likewise frustoconical, being suitable for penetrating in an orifice 72. The shoe 72 is secured to a piston 76 capable of sliding in a sleeve 78 whose axis extends radially relative to the axis of the tube forming the transmission part 60'. Using hydraulic control 80, the shoe 74 of the locking finger 70 can occupy a rest position in which it is retracted, and an active position (as shown in FIG. 4A) in which the shoe 74 penetrates into the orifice 72. When the locking finger goes from the retracted position to the active position, it is desirable for the finger to be secured via a floating mount so as to facilitate penetration of the finger in the orifice 72.

FIG. 4B shows the drilling machine 10 at its end-of-drilling position. In this position, the front portion 12 of the drilling machine is in its extended position relative to the rear portion 14 of the machine, and the locking fingers 70 are engaged in a series of orifices 72*i* occupying the lowest position in the casing.

At the end of each drilling cycle, the fingers 70 need to be retracted. The rear portion 14 of the cutting machine and the transmission part 60' are then moved down through a length L and the fingers 70 are engaged in the following series of orifices 72.

FIGS. 5, 5A, and 5B show a variant of this second embodiment of the drilling equipment. This variant differs from the embodiment of FIG. 4 solely by the means which are provided for providing locking between the casing and the thrust and torque transmission part 60'.

FIG. 5 shows the drilling machine 10 with its front portion 12 and its rear portion 14 inside the borehole 50 which is fitted with casing elements 56"*a* forming the casing 56". The take-up ring 34 of the rear portion 14 of the drilling machine has a cylindrical torque and thrust take-up part 60' fixed thereto. The part 60' is identical to that shown in FIG. 4.

In this embodiment, the top end 60'*b* of the transmission part 60' is fitted with four moving latches 90 lying in a common plane orthogonal to the longitudinal axis of the parts 60' and angularly offset by 90°. These latches are described below with reference to FIGS. 5A and 5B.

As mentioned briefly, the latches 90 Co-operate with the catch elements formed in the inside face of the casing elements which are referenced 56"*a* in this variant embodiment. Each series of catch elements comprises a ring 92 projecting from the inside face of the bottom casing elements 56"*a* in order to take up thrust, and at least one longitudinal part 94 also projecting from the inside face of the casing elements and located immediately below the take-up ring 92. The longitudinal part(s) 94 serve(s) to take up the torque transmitted by the cylindrical part 60'.

Each latch 90 comprises a locking head 96 mounted in a sleeve 98 secured to the part 60' and it moves under the control of a hydraulic actuator 100. In its retracted position, the latch 90 is set back far enough to enable the latches to go past the take-up rings 92. In the extended or active position, the locking head 96 bears both against the take-up ring 92 and against the longitudinal take-up part 94.

As shown in FIG. 5B, the active face 94*a* of the part 94 is inclined, as is the corresponding face 96*a* of the locking head so as to facilitate engagement therebetween. In FIG. 5B, the locking head is drawn in continuous lines in its locking position and in dot-dashed lines in its decoupled position.

Naturally, the distance h' between two take-up rings 92 is equal to the length L of a drilling cycle.

This variant embodiment is used in exactly the same manner as the embodiment of FIG. 4.

A third embodiment of the drilling equipment is described below with reference to FIG. 6.

In this embodiment, tube elements are put successively into place as the borehole is drilled, the bottom tube element being fixed directly to the take-up ring 34 of the cutting machine 10. The top tube element is secured in translation and rotation to a cap-forming part which in turn is fixed to the top end of the casing. In other words, this succession of tube elements acts both as the transmission part 60 or 60' of the first two embodiments and as the means for securing to the casing.

Figure 6:
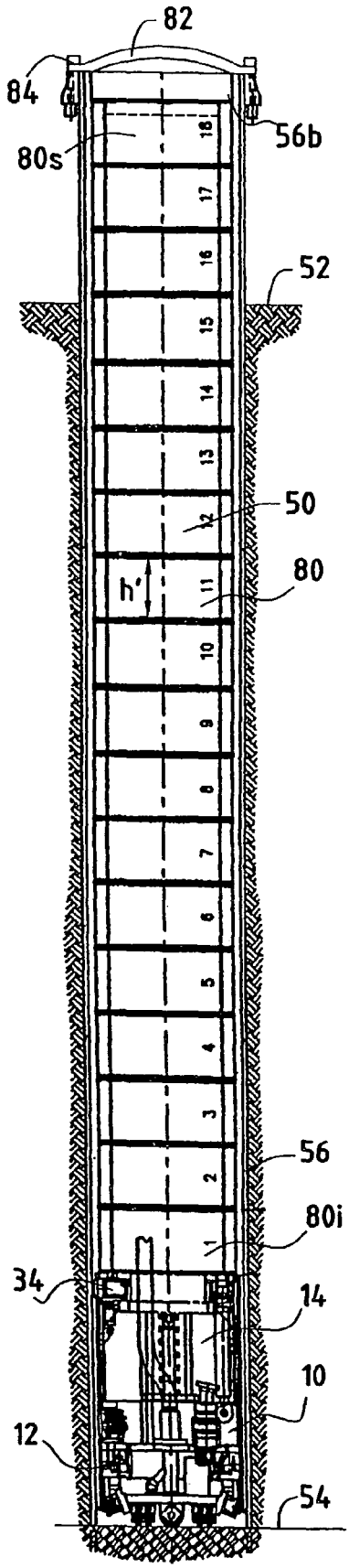
FIG. 6 is a longitudinal section view of a third embodiment of the drilling equipment.

FIG. 6 shows the cutting machine 10 with its take-up ring 34, the machine 10 being shown at the bottom of the drilled borehole immediately above the layer 54 of hard rock. The casing 56 has been put into place in the borehole where it is drilled through ground that is not hard. Its top end 56*b* of the casing projects above ground level.

As the machine 10 moves down into the hard rock, the tube elements 80 are put into place. Each tube element is of axial length h' equal to L. The bottom tube element 80*i* is bolted to the take-up ring 34, and the other tube elements are bolted to one another. The top tube element 80*s* is prevented from moving in rotation and translation by a cap-forming part 82 against which it bears. The cap-forming part 82 is fixed to the top end 56*b* of the casing 56 by securing means 84 which enable the part 82 to be engaged and disengaged quickly relative oh the casing. It will be understood that each time a length L corresponding to one drilling cycle has been achieved, it is necessary to release the part 82 and put a new "top" tube element 80*s* into place which then bears against the part 82 after it has been put back into place.

In the description above, the borehole is protected by casing elements that are put into place in succession. Under other circumstances, it would be possible to provide for the casing to be constituted as a single piece.

Similarly, in the description above, it has been assumed that drilling needs to be terminated in hard rock. This is a particularly advantageous way in which the equipment can be used. Nevertheless, the equipment of the invention can naturally also be used in other types of ground.

What is claimed is:

1. Equipment for drilling vertical boreholes in hard ground, the equipment comprising:

casing put successively into place in the borehole;

a drilling machine comprising a rotary cutting head having a diameter, a structural frame and a motor unit for rotating said cutting head with respect to said structural frame, said motor unit being mounted on said structural frame;

torque and thrust transmission means, distinct from and mounted above said drilling machine, having a lower end secured to said structural frame of the drilling machine and an upper end, said transmission means being cylindrical in shape and having a diameter substantially equal to the diameter of the cutting head;

securing means entirely mounted on said upper end of the transmission means, said securing means including movable securing members each securing member being suitable to take up second position wherein said member cooperates with a portion of said casing to secure said transmission means to said casing and a first position wherein said secunng member does not cooperate with said casing; and control means to control the position of said securing members.

2. Equipment according to claim 1, wherein said securing means comprise a plurality of tube elements securable to the upper end of the torque and thrust transmission means and securable to one another and to a fixing means for fixing a top tube element in translation and in rotation to a top end of the casing.

3. Equipment according to claim 1, wherein said drilling machine has a front portion carrying the rotary cutting head and a structural frame, a rear portion comprising a structural frame, and actuator means for moving said front portion relative to said rear portion, the lower end of said torque and thrust transmission means being secured to the structural flame of said rear portion.

4. Equipment according to claim 1, wherein said torque and thrust transmission means comprise a cylindrical part of longitudinal axis that coincides with the axis of the casing.

5. Equipment according to claim 1, wherein said casing is constituted by a plurality of casing elements that are connected to one another.

6. Equipment according to claim 1, wherein said securing means comprise a plurality of catch elements formed in the inside face of the casing, and moving locking members mounted at the upper end of the torque and trust transmission means, said locking members being suitable for taking up a refracted first position at rest and an active second position in which they Co-operate in rotation and in translation with the catch elements.

7. Equipment according to claim 6, wherein the catch elements comprise a series of through orifices formed in said casing, the orifices in a given series being disposed in a common plane orthogonal to the longitudinal axis of the casing, the series of orifices being offset in the axial direction of the casing, and wherein the moving locking members comprise a plurality of locking fingers that are movable radially between a retracted first position at rest and an active second position in which said fingers penetrate into the orifices of a series of orifices.

8. Equipment according to claim 7, wherein said orifices and said locking fingers are frustoconical.

9. Equipment according to claim 6, wherein said catch elements comprise a series of catch pieces projecting from the inside face of the casing, the catch pieces in a given series being disposed in a common plane perpendicular to the longitudinal axis of the casing, said series being offset in the axial direction of the casing, and wherein the moving locking members comprise a plurality of latches movable radially between a refracted first position at rest and an active second position in which said latches Co-operate with said catch pieces both in rotation and in translation.

10. Equipment according to claim 9, wherein each series of catch elements comprises an annular part projecting from the inside face of the casing and a plurality of longitudinal parts that are angularly spaced apart and that project from the inside wall of the casing.

11. Equipment according to claim 1, wherein said securing means comprise an annular body secured to the upper end of the torque and thrust transmission means, and expandable means mounted on the outside face of said body and suitable for occupying a first position at rest and an active second position in which the expandable means apply pressure to the inside face of the casing.

12. Equipment according to claim 11, wherein said expandable means comprise a plurality of inflatable envelopes secured to the outside face of said cylindrical body, and means for injecting a fluid under pressure into said inflatable envelopes and for removing said fluid from said envelopes.

13. Equipment according to claim 11, wherein said expandable means comprise a plurality of shoes mounted to move relative to said body, and displacement means for applying said shoes with pressure against the inside face of the casing.

14. Equipment according to claim 11, wherein said drilling machine has a front portion carrying the rotary cutting head and a structural frame, a rear portion comprising a structural frame, and actuator means for moving said front portion relative to said rear portion, the lower end of said torque and thrust transmission means being secured to the structural frame of said rear portion.

15. Equipment according to claim 11, wherein said torque and thrust transmission means comprise a cylindrical part of longitudinal axis that coincides with the axis of the casing.

16. Equipment according to claim 11, wherein said casing is constituted by a plurality of casing elements that are connected to one another.

* * * * *